United States Patent [19]

Junkers

[11] 4,387,611

[45] Jun. 14, 1983

[54] HYDRAULIC WRENCH FOR SIMULTANEOUSLY TIGHTENING OR LOOSENING AT LEAST TWO THREADED CONNECTORS

[76] Inventor: John K. Junkers, 7 Arrowhead La., Saddle River, N.J. 07458

[21] Appl. No.: 265,234

[22] Filed: May 19, 1981

[51] Int. Cl.[3] ..... B25B 13/00

[52] U.S. Cl. ..... 81/57.36; 81/57.39

[58] Field of Search ..... 81/57.36, 57.39, 61; 74/577 M, 577 R, 577 S; 254/107

[56] References Cited

U.S. PATENT DOCUMENTS

| | | | |
|---|---|---|---|
| 3,287,999 | 11/1966 | Kreckel et al. | 81/57.36 |
| 4,269,088 | 5/1981 | Dukes | 81/57.39 |
| 4,308,767 | 1/1982 | Wilmeth | 81/57.39 |

*Primary Examiner*—James L. Jones, Jr.
*Attorney, Agent, or Firm*—Michael J. Striker

[57] ABSTRACT

A hydraulic wrench for simultaneous tightening or loosening of at least two polygonal members of threaded connectors, comprising a piston reciprocable in a cylinder, a connecting member projecting to one side of the cylinder, a lever tiltably mounted intermediate its ends on the connecting member, pivotally connected at one end to the outer end of a piston rod fixed to the piston for reciprocation therewith, a ratchet gear mounted turnable about its axis in the region of the other end of the lever and provided with a coaxial polygonal opening therethrough for engaging the polygonal head of a first threaded connector to be turned, a ratchet pawl tiltably mounted on the lever and engaging the teeth of the ratchet gear, the connecting member being provided with a plurality of transversely spaced bores therethrough, and at least one link tiltably connected at one end to a selected one of the plurality of bores, a second ratchet gear turnably mounted in the region of the other end of the link and provided with a coaxial polygonal opening therethrough for engaging the polygonal member of a second threaded connector to be turned, and a ratchet pawl tiltably mounted on the link and engaging the teeth of the second ratchet gear thereon, whereby during the active stroke of the piston the members of the first and the second threaded connector to be turned and respectively engaged in said polygonal openings of the first and the second ratchet gears will be turned simultaneously.

17 Claims, 5 Drawing Figures

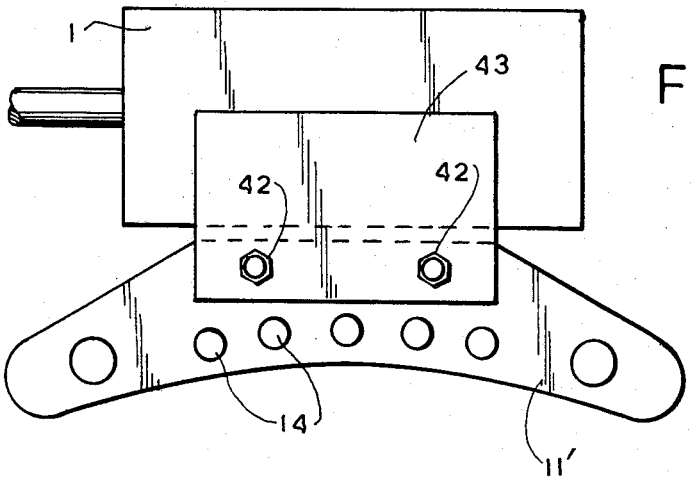
FIG. 3
FIG. 4
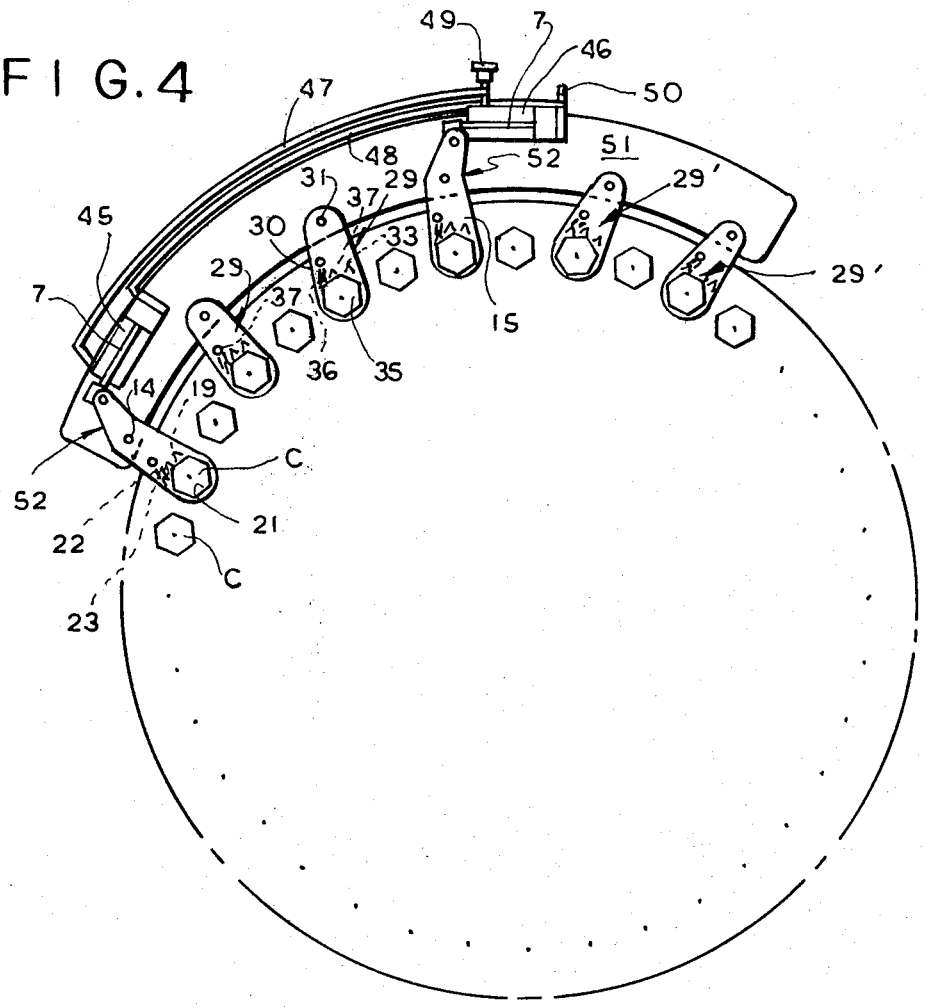

HYDRAULIC WRENCH FOR SIMULTANEOUSLY TIGHTENING OR LOOSENING AT LEAST TWO THREADED CONNECTORS

BACKGROUND OF THE INVENTION

There are many applications in which a plurality of threaded connectors, usually arranged spaced from each other along a circle, have to be tightened or loosened. Such applications are for instance abutting flanges of pipes in a pipeline which are connected by bolts extending through aligned bores in the flanges of the pipes, or covers of atomic reactors which have to be tightly connected by a plurality of bolts. Up to now such bolts have been individually tightened, which is of course quite a time-consuming task. While for some special applications apparatuses have already been provided by means of which several bolts or other threaded connectors could be tightened or loosened simultaneously, in such known apparatus a separate fluid-operated driving element has been used for tightening or loosening each bolt or any other threaded connector, and such apparatus is extremely complicated, heavy and expensive, so that the handling thereof is likewise difficult.

SUMMARY OF THE INVENTION

It is therefore an object of the present invention to provide an apparatus, that is a hydraulically operated wrench, in which at least two threaded connectors may be simultaneously tightened or loosened and in which the apparatus is simple in its construction so that it can be manufactured at reasonable cost and which is lighter than such known apparatus so that it can be handled with relative ease.

With these and other objects in view, which will become apparent as the description proceeds, the hydraulic wrench according to the present invention mainly comprises fluid-operated cylinder-and-piston means including a cylinder, a piston reciprocatable therein between an active and a return stroke, and a piston rod fixed at one end to the piston and projecting with its other end beyond the cylinder, connecting means connected to the cylinder projecting to one side thereof, ratchet lever means pivotally mounted between its ends on the connecting means for tilting movement about a first pivot axis normal to the connecting means, pivotally connected at one end to the other end of the piston rod and provided in the region of its other end with means for engaging a threaded connector to be turned during the active stroke of the piston, ratchet link means pivotally attached at one end to the connecting means for tilting movement about a second pivot axis parallel to the first pivot axis and transversely spaced therefrom in which the ratchet link means is provided in the region of its other end with means for engaging an other threaded connector, whereby during the active stroke of the piston the cylinder and the connecting means will be moved substantially in the direction of the active stroke of the piston to tilt the ratchet link means in the same direction as the ratchet lever means so that both threaded connectors will be simultaneously turned.

The ratchet lever means comprise lever means mounted intermediate its ends on the connecting means for tilting movement about the mentioned first pivot axis and pivotally connected at one end to the other end of the piston rod, a first ratchet gear mounted in the region of the other end of the lever means for turning about its axis, and at least one ratchet pawl mounted at one end on the lever means tiltable about an axis parallel and transversely spaced from the first pivot axis and engaging with the other end thereof the teeth of the first ratchet gear. The means for engaging the threaded connector are provided on the first ratchet gear coaxial therewith.

The ratchet link means, on the other hand, comprise link means mounted in the region of one end on the connecting means for tilting movement about a second pivot axis, a second ratchet gear mounted in the region of the other end of the link means for turning about its axis, and at least one ratchet pawl pivotally mounted at one end on the link means laterally spaced from the second pivot axis and engaging with its other end the teeth of the second ratchet gear. The means for engaging a second threaded connector are again provided on the second ratchet gear coaxial therewith.

The ratchet link means is releasably attached to the connecting means by a pivot pin extending through a bore of the connecting means concentric with the second pivot axis and the connecting means is provided with a plurality of transversely spaced bores so that the link means may be attached to the connecting means at a selected one of a plurality of distances from the lever means or to be exchanged against another ratchet link means having different means for engaging a threaded connector to be turned. Likewise, the ratchet lever means are releasably connected to the other end of the piston rod and also releasably connected to the connecting means so as to be exchangeable against another ratchet lever means having different means for engaging a threaded connector to be turned.

The means on the ratchet lever means and on the link means for engaging a threaded connector to be turned may comprise a hexagonal opening extending through the respective ratchet gear coaxial therewith or a square opening for receiving a square shank of a standard socket wrench.

The aforementioned connecting means may comprise a pair of transversely spaced plates projecting from one side of the cylinder integral therewith and being respectively provided with a plurality of transversely spaced bores therethrough which are respectively aligned in pairs in the two plates, or the connecting means may comprise an elongated flat member releasably connected to one side of the cylinder and provided with a plurality of transversely spaced bores therethrough. In either case, the ratchet lever means are releasably attached to the connecting means to be exchangeable against a ratchet lever means having different means for engaging a threaded connector and the link means are likewise releasably attached to a selected one of the bores to change the distance between the first and the second pivot axes in accordance with the spacing of the thread connectors to be turned or to exchange the link means against another one having different means for engaging the threaded connectors to be turned.

The aforementioned elongated flat member may be curved along a predetermined radius corresponding to a radius along which a plurality of threaded connectors to be turned are arranged, and of course in this case the bores are arranged spaced from each other along a radius parallel to the predetermined radius. In this arrangement a plurality of ratchet link means may be provided, each releasably attached at its one end thereof to a selected one of the plurality of bores so that more than two threaded connectors may be simultaneously turned.

In order to assure that, when a relatively great number of threaded connectors should be simultaneously tightened or loosened, sufficient power for this purpose is available without unduly increasing the dimension of the cylinder-and-piston means, the elongated curved member may be releasably attached to two cylinder-and-piston means spaced in direction of the elongation of the curved member from each other, wherein the elongated curved member is provided with two bores spaced a predetermined distance in the direction of the elongation of the members from each other for releasably connecting each of two ratchet lever means for tilting movement about respective first pivot axes with one end of each ratchet lever means releasably connected to the other end of the respective piston rod of the two cylinder-and-piston means and wherein the member is further provided with a first plurality of additional bores located spaced from each other between the first two mentioned bores and a second plurality of additional bores spaced from each other and following in the direction of the curved member one of the first mentioned bores, and at least two ratchet link means respectively tiltably connected at one of the ends thereof to a respective one of the first plurality of additional bores and at least two further ratchet link means tiltably connected at one of the ends thereof to a respective one of the second plurality of additional bores.

The elongated curved member may comprise two semicircular ring parts having opposite ends abutting against each other, and the two cylinder-and-piston means are releasably connected to the two semicircular ring parts for holding the opposite ends thereof in abutting relationship. The aforementioned construction may include two additional cylinder-and-piston means respectively releasably connected to the two ring parts intermediate the opposite ends thereof.

Since it happens sometimes, especially during simultaneous loosening of tightly applied threaded connectors, that one of the connectors requires a greater force for turning the same than the other one, the wrench according to the present invention is also provided with means for disengaging the pawl or pawls of the ratchet level means or the pawl or pawls of the ratchet link means from the respective ratchet, so that the full force of the cylinder-and-piston means may be applied to that threaded connector in which the pawl or pawls engage the respective ratchet.

The novel features which are considered characteristic for the invention are set forth in particular in the appended claims. The invention itself, however, both as to its construction and its method of operation, together with additional objects and advantages thereof, will be best understood from the following description of preferred embodiments when read in connection with the accompanying drawing.

BRIEF DESCRIPTION OF THE DRAWING

FIG. 3 partly shows a modified arrangement in which the connecting means are releasably attached to the cylinder of the cylinder-and-piston means;

FIG. 4 schematically illustrates a further embodiment for simultaneously turning more than two threaded connectors.

DESCRIPTION OF THE PREFERRED EMBODIMENTS

Figure 1:
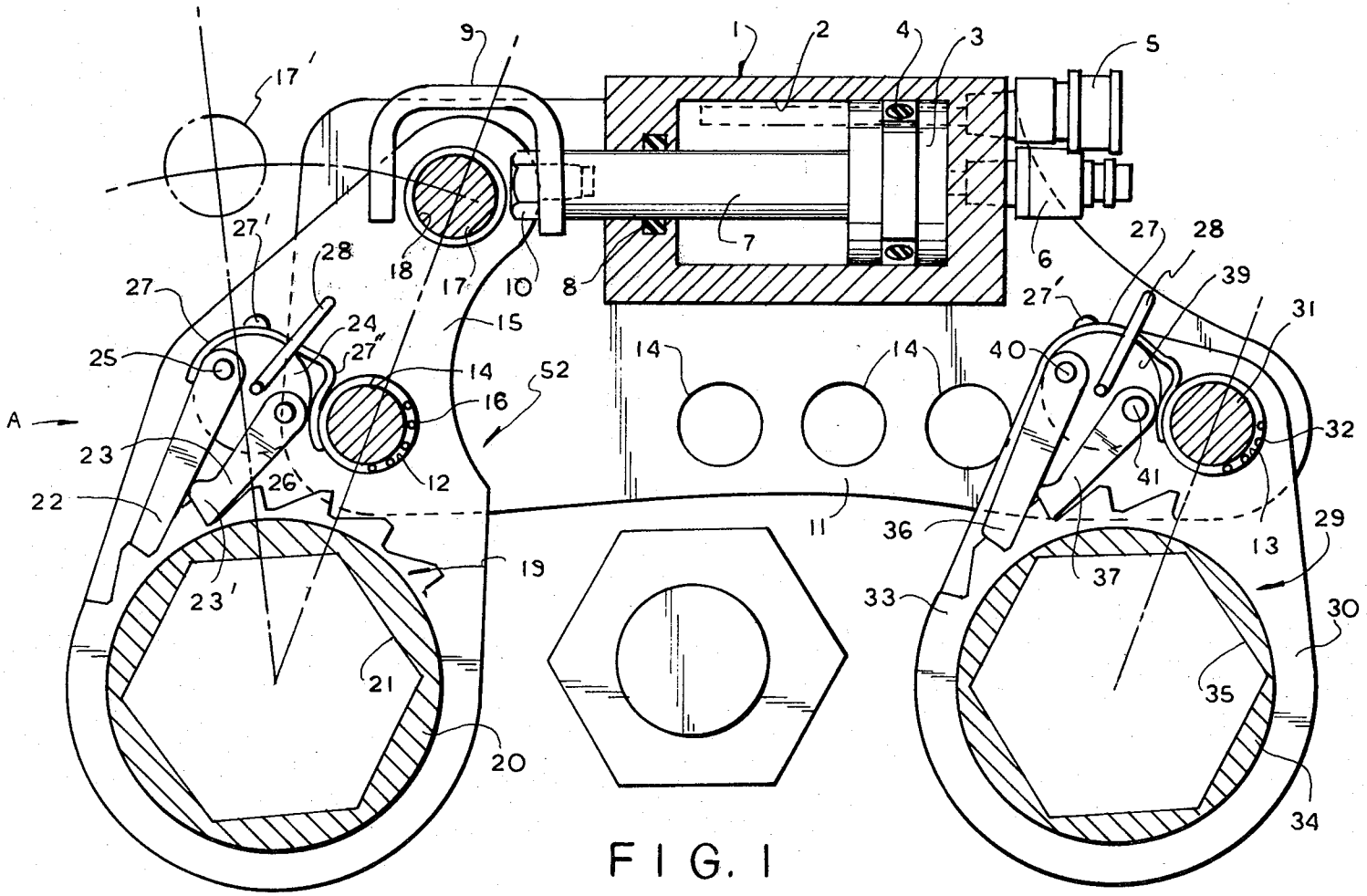
FIG. 1 is a vertical cross-section through one embodiment of a hydraulic wrench according to the present invention, the cross-section being taken along the line I—I of FIG. 2.
Figure 2:
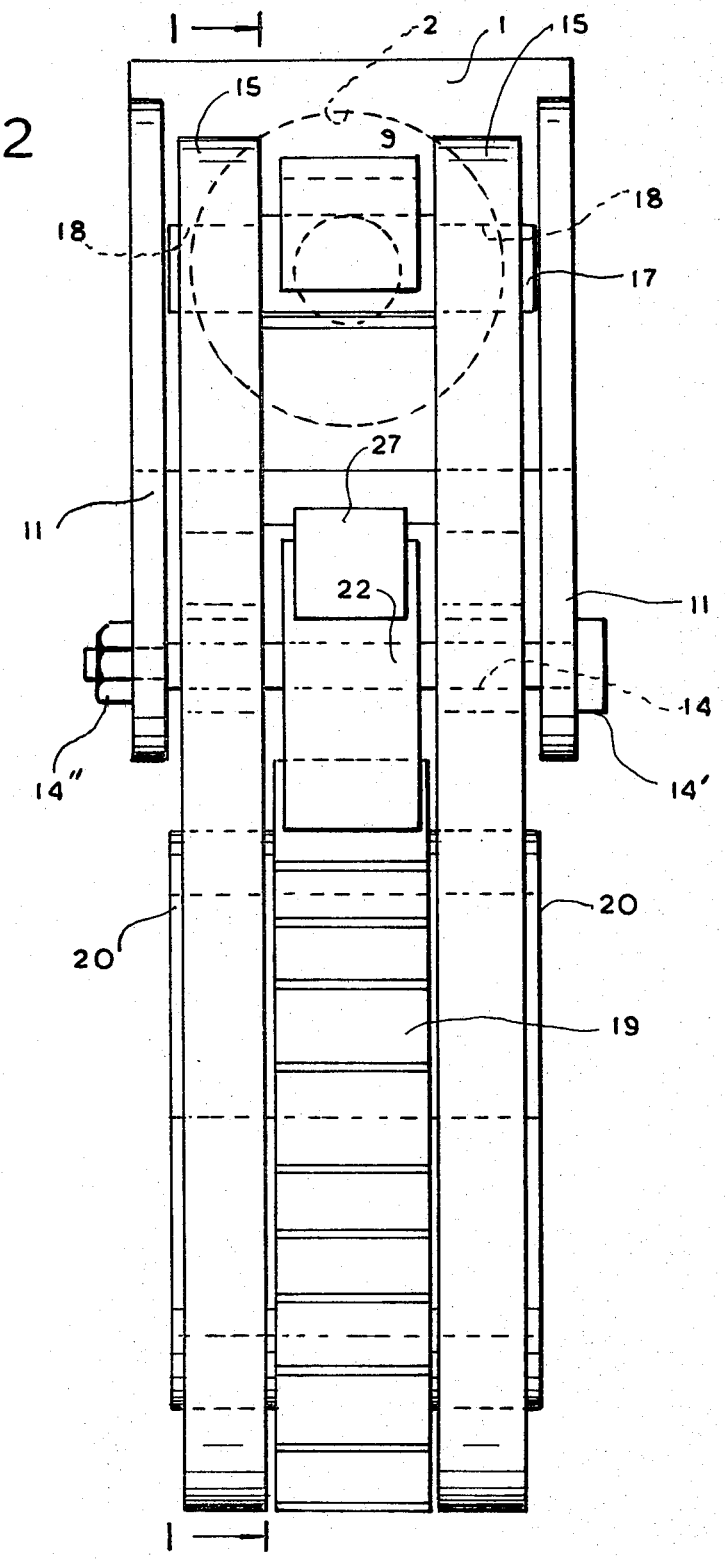
FIG. 2 is a front view of the embodiment shown in FIG. 1, viewed in the direction of the arrow A.

Referring now to the drawing, and more specifically to FIGS. 1 and 2, in which a first embodiment of the hydraulic wrench according to the present invention is illustrated, it will be seen that this embodiment comprises fluid-operated cylinder-and-piston means including a cylinder 1, preferably of square outer surface, as best shown in FIG. 2, and provided with a coaxial cylinder bore 2 in which a piston 3 provided with an annular seal 4 is reciprocatable between an active stroke, towards the left as viewed in FIG. 1, and a return stroke. Nipples 5 and 6 are threadedly connected in corresponding bores in the right end wall of the cylinder 1 and communicate through appropriate passages with opposite ends of the interior of the cylinder 1 for feeding, respectively discharging, pressure fluid in a known manner from a source not illustrated in the drawing into and from the cylinder to thereby reciprocate the piston between the active and the return stroke. A piston rod 7 is connected at one end in any suitable manner to the piston 3 concentric therewith to project with its left end, as viewed in FIG. 1, sealed by sealing ring 8 through an opening in the left end wall of the cylinder 1 beyond the latter. A U-shaped member 9 is attached by a screw bolt 10 to the free end of the piston rod 7. Connecting means in the form of two transversely spaced side plates 11, which may be integrally cast with the cylinder 1, project downwardly from one side of the cylinder 1 as well as forwardly and rearwardly of the latter. The side plates 11 are provided in the region of the front ends thereof with aligned bores 12 and in the region of the rear or right ends thereof with aligned bores 13. Intermediate the bores 12 and 13 the sides plates 11 are further provided with a plurality of bores 14 transversely spaced, preferably through equal distances, from each other and preferably along a line connecting the centers of the bores 12 and 13 with each other. A pivot pin 14 extends through the aligned bores 12 in the side plates 11 on which a pair of levers 15 are tiltably mounted by means of needle bearings 16 press-fitted in corresponding bores of the levers 15. A stepped pin 17 having a large-diameter portion between the levers 15 extends with small-diameter portions through aligned bores 18 in the two levers 15. The large-diameter portion of the pin 17 is encompassed by the above mentioned U-shaped member 9 fastened to the free end of the piston rod 7 so that during reciprocation of the piston 3 in the cylinder 1 the levers 15 are tilted back and forth about the axis of the pivot pin 14. A ratchet gear 19 is arranged in the region of the lower ends of the levers 15 between the latter and turnably mounted on these levers by means of a pair of trunnions 20 projecting to opposite sides of the gear 19 through correspondingly aligned bores in the levers 15. A polygonal opening, for instance a hexagonal opening 21, extends coaxially with the ratchet gear 19 through the latter and the trunnions 20 projecting to opposite sides thereof for engagement with a corresponding polygonal portion of a threaded connector to be turned. Preferably two ratchet pawls 22 and 23 are provided to engage with the lower ends thereof the teeth of the ratchet gear 19, whereas the upper ends of the pawls 22 and 23 are titltably mounted in cut-outs of a cylindrical member 24 by means of pins 25 and 26. The member 24, in turn, has reduced-diameter portions extending to opposite sides thereof which are turnably mounted in appropriate bores of the levers 15. This arrangement known per se from a copending application Ser. No. 225,408 will assure that the driving force created by the cylinder-and-piston means will be equally applied to two adjacent teeth of the ratchet gear to prevent the teeth from breaking. A leaf spring 27 is attached for instance by a screw 27' to the cylindrical member 24 to engage the front left face of the pawl 22 to hold the latter in engagement with the teeth of the ratchet gear 19 and the pawl 23 may be provided with a nose 23' engaging the rear or right face of the pawl 22 so that the spring 27 will act also on the pawl 23. The spring 27 is provided with an outwardly bulging portion 27'' for the purpose as will be described further below, and a fork-shaped lever 28 pivotally mounted at the center of the cylindrical member 24 is provided for cooperating with the bulging portion 27'' in a manner to be described below. The levers 15 together with the ratchet gear 19 and the pawls 22 and 23 form ratchet lever means 52 releasably mounted intermediate its ends on the connecting means, that is the side plates 11, for tilting movement about a first pivot axis, that is the axis of the pivot pin 14. As best shown in FIG. 2, the pivot pin 14 has a head 14' at one end thereof whereas a nut 14'' is screwed onto the opposite threaded end of the pivot pin. The upper end of the ratchet lever means is pivotally and releasably connected to the free end of the piston rod by the pin 17 extending between the two levers 15 and the U-shaped member 9 connected to the piston rod. By unscrewing the nut 14'' and withdrawal of the pivot pin 14, the whole ratchet lever means may therefore be removed from the wrench, and the ratchet 19 may be exchanged against a different one, for instance a ratchet which is provided with a square opening instead of the hexagonal opening 21 shown in FIG. 1 and a corresponding square shank of a standard socket may then be inserted into the square opening of the ratchet gear.

The embodiment of the hydraulic wrench according to the present invention shown in FIGS. 1 and 2 includes further ratchet link means 29 comprising link means, that is a pair of plate-shaped links 30, of which only the rear one is shown in FIG. 1, which are arranged transversely spaced from each other between the side plates 11. The plate-shaped links 30 are connected in the region of the upper ends thereof to the side plates 11 by a pivot pin 31 extending through the bores 13 in the side plates 11 and through needle bearing 32 press-fitted in corresponding bores of the link plates 30. A ratchet gear 33 of the same size and construction as the ratchet gear 19 is arranged between the link plates 30 and mounted turnable about its axis by means of coaxial trunnions 34 projecting from opposite sides of the ratchet gear 33 through corresponding bores in the link plates 30. A hexagonal opening 35 coaxial with the axis of the ratchet gear 33 is also provided through the latter and the trunnions projecting therefrom for engagement with a second threaded connector to be turned. The ratchet link means 29 includes further two pawls 36 and 37 engaging with lower ends thereof adjacent teeth of the ratchet gear 33 whereas the upper ends are tiltably mounted in cut-outs of a cylindrical member 39 by means of pins 40 and 41 in the same manner as described in connection with the pawls 22 and 23 cooperating with the ratchet gear 19. The arrangement further includes a leaf spring 27 fastened by screw 27' to the member 39 and cooperating with the forked lever 28. The pivot pin 31 is constructed in the same manner as the pivot pin 14 so that the link means 29 are releasably connected to the connecting means constituted by the side plates 11.

The above described embodiment of the hydraulic wrench according to the present invention illustrated in FIGS. 1 and 2 will operate as follows:

During the active stroke of the piston 3 in the cylinder 1, that is during the movement of the piston to the left as viewed in FIG. 1, the pin 17 will, assuming that the head of a threaded connector is located in the hexagonal opening 21, swing through an arc about the center of the opening 21 to the position 17' shown in dotted lines in FIG. 1, while the cylinder 2 and the connecting means constituted by the side plates 11 will also move to the left due to the pivotal connection of the levers 15 with the side plates 11 by the pivot pin 14. This shifting movement of the connecting means or the side plates 11 will also shift the pivot pin 31 pivotally connecting the link means 29 to the side plates 11 so that the ratchet pawls 22 and 23 will turn the ratchet 19 and the ratchet pawls 36 and 37 will turn the ratchet 33 through equal angles and with the same turning moment if the distance between the center of the member 24 to the center of the ratchet gear 19 is equal to the distance of the member 39 from the center of the ratchet gear 34 and if the plane including the axis of the member 24 and that of the ratchet gear 19 is parallel to the plane including the axis of the member 39 and that of the ratchet gear 33.

It sometimes happens that during the attempt to turn two threaded connectors simultaneously with the apparatus of the present invention that one of the threaded connectors engaged in the opening 21 or in the opening 35 is extremely hard to turn, so that the force provided by the cylinder-and-piston means is not sufficient to turn both of the threaded connectors simultaneously. In such a case the operator may turn one of the levers 28 to engage the bulging portion 27'' of the respective spring 27 whereby the right arm of the spring is lengthened to engage the ratchet pawl 23 or 37 below the pivot point thereof, to lift the respective ratchet pawl out of engagement with the teeth of the respective ratchet gear, and correspondingly also the adjacent pawl so that the full force of the cylinder-and-piston means will be applied only to that ratchet gear in which the pawls still engage the teeth thereof. The other ratchet gear, which will not be turned in this case, serves only to take up the reaction force during this operation.

If the spacing of the threaded connectors to be turned should be different from that shown in FIG. 1, the wrench can be easily adapted for such different spacing by simply removing the pivot pin 31 of the ratchet link means 29 and inserting the pivot pin 31 in one of the bores 14. It is also possible to do so even if the spacing of the threaded connectors to be turned is the same as shown in FIG. 1, in which case the moment applied to the threaded connector inserted in the opening 35 of the ratchet link means 29 will be different from the moment applied to the threaded connector inserted into the opening 21. Furthermore, by releasably connecting the ratchet lever means and the ratchet link means to the side plates 11, it is possible to easily remove the ratchet lever means and the ratchet link means from the apparatus and exchange the same for a ratchet lever means or a ratchet link means having different openings in the ratchet gears, so that the apparatus may be universally used.

FIG. 3 partly illustrates a slightly modified arrangement in which the connecting means, that is the side plates 11', are releasably connected by bolts 42 to plates 43 integrally cast to opposite sides of the cylinder 1 and projecting slightly beyond the bottom thereof. In this way side plates of different configuration and with bores 14 of different spacing and/or number in accordance with the spacing of the threaded connectors to be turned, may be attached to the cylinder 1.

FIG. 4 schematically illustrates at a reduced scale a further embodiment according to the present invention for simultaneously turning not only two but at least six threaded connectors at the same time, especially threaded connectors C which are arranged equally spaced from each other along a circle. In this embodiment, two cylinder-and-piston means 45 and 46 are provided circumferentially spaced from each other and constructed substantially identical to the cylinder-and-piston means 1–8 shown in FIG. 1 with the exception that the two cylinder-and-piston means 45 and 46 are both connected to common supply lines 47 and 48 for respectively feeding and discharging pressure fluid into and from opposite ends of the cylinders of the cylinder-and-piston means 45 and 46, and the nipples 49 and 50 of the two conduits 47 and 48 are connected in a manner known per se to a source of pressure fluid not shown in the drawing for feeding respectively discharging pressure fluid therefrom. The connecting means in this embodiment comprise a single elongated plate 51 arranged substantially in a plane of symmetry of the two cylinder-and-piston means 46, either integrally cast with the cylinders thereof or preferably fixed thereto in any suitable manner. The connecting plate 51 is curved along a radius parallel to the radius along which the threaded connectors C to be turned are arranged. The piston rods 7 of the two cylinder-and-piston means 45 and 46 are connected to the upper ends of ratchet lever means 52 which may be constructed substantially in the same manner as the ratchet lever means 52 shown and described in connection with FIG. 1, with the only difference that the two levers 15 of each of the ratchet lever means 52 are in this case arranged to opposite sides of the connecting means or connecting plate 51. Otherwise, the construction of the ratchet lever means 52 is identical with the construction of the ratchet lever means 52 shown in FIG. 1, and each of the ratchet lever means 52 is tiltable about a pivot pin 14 and releasably connected by this pivot pin to the connecting plate 51 while carrying in the region of its lower end a ratchet gear 19 formed with a hexagonal central opening 21 and cooperating with two ratchet pawls 22 and 23 shown in FIG. 4 in a simplified manner. Two ratchet link means 29, substantially of the same construction as the ratchet link means 29 shown in FIG. 1, are arranged circumferentially spaced from each other between the cylinder-and-piston means 45 and 46 and two additional ratchet link means 29' are arranged circumferentially spaced from each other on the portion of the connecting plate 51 extending toward the right, as viewed in FIG. 4, beyond the cylinder-and-piston means 46. All the ratchet link means 29 and 29' are of identical construction, substantially identical with the construction of the ratchet link means shown in FIG. 1, again with the only difference that in this case the two plates 30 of each ratchet link means are arranged to opposite sides of the central connecting plate 51. As described in connection with FIG. 1, the plates 30 of each ratchet link means 29 or 29' are pivotally and releasably connected to the connecting means 51 by a pivot pin 31 and each comprises in the region of its lower end a ratchet gear 33 mounted on the plates 30 for turning about its axis and provided with a central hexagonal opening 35, while two pawls 36 and 37 cooperate with the ratchet gear 33.

If the connecting plate 51 is releasably attached to the cylinders of the two cylinder-and-piston means 45 and 46, it may be exchanged against a different connecting plate having a different curvature than that shown in FIG. 4 and different spacing of the bores for the pivot pins 14 and 31.

The operation of the embodiment shown in FIG. 4 will be substantially the same as the operation of the embodiment illustrated in FIGS. 1 and 2 and described above. During the active stroke of the pistons of the cylinder-and-piston means 45 and 46, the ratchet lever means 52 will be tilted about the pivot pins 14 to turn the ratchet gears 19 and the threaded connectors engaged in the openings 21 thereof while at the same time the connecting plate 51 will be circumferentially and counter clockwise shifted to thereby tilt also the ratchet link means 29 and 29' to turn thereby the threaded connectors engaged in the hexagonal openings 35 of the ratchet link means.

Figure 5:
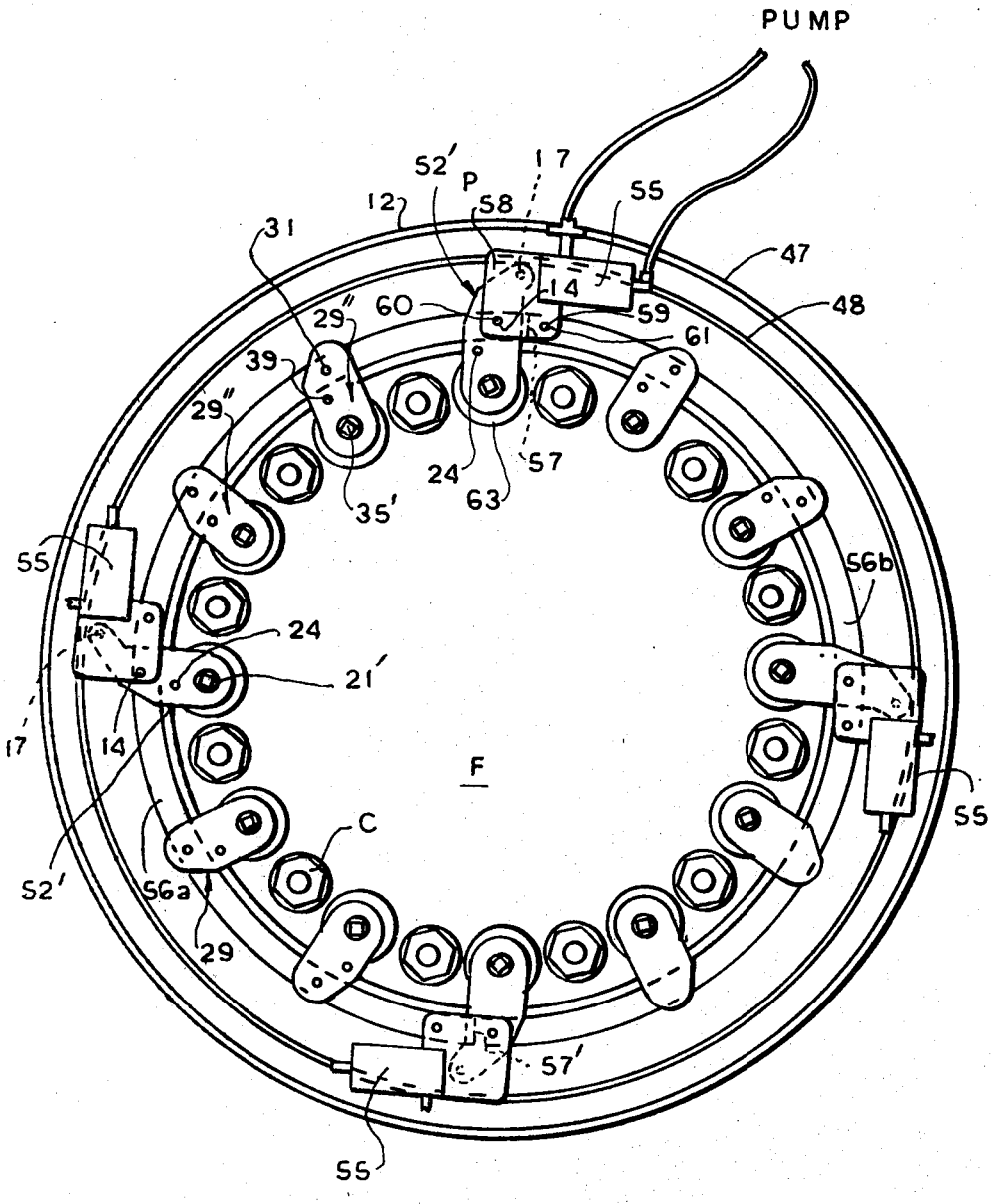
FIG. 5 schematically illustrates a further embodiment in which the connecting means comprise two ring halves and in which the apparatus is provided with four cylinder-and-piston means, each connected to a respective ratchet lever means and in which eight link means are connected to the ring halves so that a total of twelve threaded connectors may be simultaneously turned.

FIG. 5 schematically illustrates a further embodiment according to the present invention, which is constructed for special applications in which a great number of threaded connectors equally circumferentially spaced from each other provided on identical flanges of pipes or on identical covers are to be turned simultaneously. In the embodiment schematically shown in FIG. 5, there are twenty-four threaded connectors C arranged circumferentially spaced from each other on a flange F of predetermined diameter. FIG. 5 schematically illustrates an embodiment according to the present invention permits to turn the twenty-four threaded connectors with two set-ups. The embodiment shown in FIG. 5 comprises four cylinder-and-piston means 55 and it is to be understood that each of these cylinder-and-piston means comprises a cylinder, preferably of square cross-section formed with a cylinder bore in which a piston provided with a piston rod is reciprocated in the manner as described in connection with FIG. 1. As shown in FIG. 5, the cylinder-and-piston means 55 are circumferentially displaced from each other through 90°. The connecting means in this embodiment are constituted by two ring halves 56*a* and 56*b* curved in correspondence with the outer circumference of the flange F and abutting with opposite ends at 57 and 57' against each other. All of the cylinder-and-piston means 55 are provided with a pair of transversely spaced plate 58 projecting downwardly and forwardly therefrom and respectively arranged to opposite sides of the ring halves 56*a* and 56*b*. Each of the plates 58 is provided with two transversely spaced bores 59 and 60 aligned with corresponding bores in the other plate and also aligned with corresponding bores extending through the ring halves 56*a* or 56*b*. A connecting bolt 61 extends through the aligned bores 59 and the pivot pin 14 of ratchet lever means 52' extends through the aligned bores 60. In this way if the abutting ends 57 and 57' of the two ring halves 56*a* and 56*b* are held in abutting relationship by the connecting bolts 61 and the pivot pins 14 of the cylinder-and-piston means 55 arranged in the region of the abutting ends 57 and 57' of the two ring halves. The outer end of the piston rod of each cylinder-and-piston means is connected in the manner as shown and described in connection with FIG. 1 to the transverse pin 17 at the upper end of each ratchet lever means 52' and the latter is constructed very similar to that shown and described in connection with FIG. 1, with the difference that the pivot pin 14 and the member 24 which carries the two pawls 22 and 23, not shown in FIG. 5, are arranged slightly different with respect to each other, since evidently the member 24 has to be arranged inwardly of the respective ring halves 56*a* or 56*b* so as not to interfere with the tilting of the ratchet lever means 52' during reciprocation of the piston of the cylinder-and-piston means 55. It is to be understood that each of the ratchet lever means 52' comprises also a ratchet gear 19, for reasons of simplicity now shown in FIG. 5, cooperating with the two ratchet pawls 22 and 23 mounted on the member 24 and likewise not illustrated in FIG. 5. A further difference between the ratchet lever means 52' from the ratchet lever means 52 shown in FIG. 1 is that the ratchet gear and the trunnions thereof are not provided with a hexagonal opening therethrough but with a square opening 35' in which the square shank of a standard socket wrench 63 is engaged which in turn engages the threaded connector C to be turned. Of course, it would also be possible to provide each of the ratchet gears and the trunnions thereof with a hexagonal opening therethrough as shown in FIG. 1.

Two ratchet link means 29'' are arranged between each two ratchet lever means 52' equally spaced from the latter and from each other. Each of the ratchet link means 29'' is constructed substantially in the same manner as the ratchet link means 29 shown in FIG. 1, again with the difference that the spacing between the pivot pin 31 thereof and that of the cylindrical member 39 is different from that shown in FIG. 1 in that the cylindrical member 39 has again be placed inwardly spaced from the ring halves 56*a* and 56*b* so as not to interfere with the tilting thereof. Furthermore, it is to be understood that each of the ratchet link means 29'' comprises also a ratchet gear, not shown in FIG. 5 turnably mounted in the region of the lower end of each ratchet link means and two pawls, likewise not shown in the drawing, pivotally mounted on the member 39 to engage with the lower end thereof the teeth of the ratchet gear. A further difference between the ratchet link means 39'' and the ratchet link means 29 shown in FIG. 1 is that the ratchet gear and the trunnions thereof are provided with a coaxial square opening 35' therethrough in which the correspondingly square shank of a standard socket wrench 63 is located.

Opposite ends of the cylinders of each cylinder-and-piston means 55 are again connected to each other by common circularly arranged conduits 57 and 48 which in turn are connected to a source of pressure fluid not shown in the drawing for alternately feeding respectively discharging pressure fluid from opposite ends of the cylinders of the cylinder-and-piston means 55 to thereby reciprocate the piston of each cylinder-and-piston means between an active and return stroke.

It is believed to be unnecessary to describe the operation of the embodiment shown in FIG. 5 in detail, since it operates in the same manner as described in connection with FIG. 4. With the embodiment illustrated in FIG. 5 twelve threaded connectors will be turned at the same time and after the twelve engaged threaded connectors C have been properly turned, the whole arrangement is lifted to disengage the socket wrenches 63 from the respective threaded connectors C and then turned through an angle of 15° to engage the other threaded connector so that all threaded connectors will be properly turned in two set-ups of the apparatus shown in FIG. 5.

It will be understood that each of the elements described above, or two or more together, may also find a useful application in other types of hydraulic wrenches differing from the types described above.

While the invention has been illustrated and described as embodied in a hydraulic wrench for simultaneously tightening or loosening at least two threaded connectors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that from the standpoint of prior art fairly constitute essential characteristics of the generic or specific aspects of this invention.

What is claimed as new and desired to be protected by Letters Patent is set forth in the appended claims:

1. A hydraulic wrench comprising fluid-operated cylinder-and-piston means including a cylinder, a piston reciprocatable in said cylinder between a forward stroke and a return stroke and a piston rod fixed at one end to said piston and projecting at its other end beyond said cylinder; connecting means connected to said cylinder projecting to one side thereof; ratchet lever means pivotally mounted between its ends on said connecting means for tilting movement about a first pivot axis, pivotally connected at one end to said other end of said piston rod and provided in the region of its other end with means for engaging a polygonal member of a first threaded connector to be turned during the active stroke of said piston; ratchet link means pivotally attached at one end to said connecting means for tilting movement about a second pivot axis parallel to said first pivot axis and transversely spaced therefrom, said ratchet link means being provided in the region of the other end thereof with means for engaging the polygonal member of a second threaded connector, whereby during said active stroke of said piston said cylinder and said connecting means will be shifted substantially in the direction of said active stroke to tilt said ratchet link means in the same direction as said ratchet lever means so that the members of two threaded connectors respectively engaged in the engaging means of said ratchet lever means and said ratchet link means will be simultaneously turned.

2. A hydraulic wrench as defined in claim 1, wherein said ratchet lever means comprises lever means mounted intermediate its ends on said connecting means for tilting movement about said first pivot axis and pivotally connected at one end to said other end of said piston rod, a first ratchet gear mounted in the region of the other end of said lever means for turning about its axis, and at least one ratchet pawl mounted at one end on said lever means tiltable about a first tilting axis parallel to and transversely spaced from said first pivot axis and engaging with the other end thereof said teeth of said first ratchet gear, said means for engaging the polygonal member of a first threaded connector being provided on said first ratchet gear coaxial therewith.

3. A hydraulic wrench as defined in claim 2, wherein said ratchet link means comprises link means mounted in the region of one end on said connecting means for tilting movement about said second pivot axis, a second ratchet gear mounted in the region of the other end of said link means for turning about its axis, and at least one ratchet pawl mounted at one end on said link means tiltable about a second tilting axis parallel to and transversely spaced from said second pivot axis and engaging with its other end the teeth of said second ratchet gear, said means for engaging the polygonal member of said second threaded connector being provided on said second ratchet gear coaxial therewith.

4. A hydraulic wrench as defined in claim 3, wherein the distance between the first tilting axis and the axis of the first ratchet gear is equal to the distance between said second tilting axis and the axis of said second ratchet gear, and wherein the plane including said first tilting axis and the axis of the first ratchet gear is parallel to a plane including said second tilting axis and the axis of said second ratchet gear so that during said active stroke of said piston the polygonal members of said first and said second threaded connectors will be turned through the same angle and with the same turning moment.

5. A hydraulic wrench as defined in claim 1, wherein said ratchet link means is releasably attached to said connecting means by a pivot pin extending through a bore of said connecting means concentric with the second pivot axis, and wherein said connecting means is provided with a plurality of transversely spaced bores so that said link means may be attached to said connecting means at a selected one of a plurality of distances from said lever means or to be exchanged against another ratchet link means having different means for engaging the polygonal member of a threaded connector to be turned.

6. A hydraulic wrench as defined in claim 1, wherein said ratchet lever means is releasably connected to said other end of said piston rod and also releasably connected to said connecting means so as to be exchangeable against another ratchet lever means having different means for engaging the polygonal member of a threaded connector to be turned.

7. A hydraulic wrench as defined in claim 3, wherein said means on said ratchet lever means and on said link means for engaging the polygonal member of a threaded connector to be turned comprises a hexagonal opening extending through the respective ratchet gear coaxial therewith.

8. A hydraulic wrench as defined in claim 3, wherein said means on said ratchet lever means and on said link means for engaging the polygonal member of a threaded connector to be turned comprises a square opening through the respective ratchet gear coaxial therewith for receiving a square shank of a standard socket wrench.

9. A hydraulic wrench as defined in claim 1, wherein said connecting means comprise plate means projecting from said one side of said cylinder integral therewith and being provided with a plurality of transversely spaced bores therethrough, and including means for releasably connecting said one end of said link means to a selected one of said bores.

10. A hydraulic wrench as defined in claim 1, wherein said connecting means comprise an elongated flat member releasably connected to said one side of said cylinder and provided with a plurality of transversely spaced bores therethrough, and including means for releasably connecting said ratchet lever means to one of said bores for tilting movement about the axis of said one bore and further means for releasably connecting said one end of said ratchet link means to another of said bores for tilting movement about the axis of the latter.

11. A hydraulic wrench as defined in claim 10, wherein said elongated flat member is curved along a predetermined radius corresponding to a radius along which a plurality of polygonal members of threaded connectors to be turned are arranged.

12. A hydraulic wrench as defined in claim 11, wherein a plurality of ratchet link means are provided, each releasably attached at said one end thereof to a selected one of said plurality of bores.

13. A hydraulic wrench as defined in claim 11, wherein said elongated curved member is releasably connected to two cylinder-and-piston means spaced in the direction of said elongated curved member from each other, and wherein said member is provided with two bores spaced a predetermined distance in the direction of the elongation of said curved member from each other for releasably connecting two ratchet lever means respectively to said two bores for tilting movement about respective first pivot axes, with one end of each ratchet lever means releasably connected to the other end of the respective piston rod of said two cylinder-and-piston means, said member being further provided with a first plurality of additional bores located spaced from each other between said first two mentioned bores and a second plurality of additional bores spaced from each other and following in the direction of said curved member one of said first mentioned bores, and at least two ratchet link means respectively tiltably connected at one of the ends thereof to respective bores of said first plurality of additional bores and at least two further ratchet link means tiltably connected at one of the ends thereof to respective bores of said second plurality of additional bores.

14. A hydraulic wrench as defined in claim 11, wherein said elongated curved member comprises two semicircular ring parts having opposite ends abutting against each other, and including at least two cylinder-and-piston means releasably connected to said two semicircular ring parts for holding said opposite ends thereof in abutting relationship, a ratchet lever means for each of said two cylinder-and-piston means, each releasably attached at one end to the other of the piston rod of the respective cylinder-and-piston means and each releasably attached intermediate its ends to a respective one of said ring parts for tilting movement about a respective first pivot axis, said ring parts being provided intermediate the opposite ends thereof with a plurality of bores therethrough spaced in circumferential direction from each other, and a plurality of ratchet link means, each releasably attached at one end to a selected one of said bores tiltable about a respective second pivot axis parallel to said first pivot axis.

15. A hydraulic wrench as defined in claim 14, and including two additional cylinder-and-piston means respectively releasably connected to said two ring parts intermediate said opposite ends thereof, and an additional ratchet lever means for each of said additional cylinder-and-piston means.

16. A hydraulic wrench as defined in claim 14, and including a first common conduit communicating with one of the ends of the cylinder of each of said cylinder-and-piston means and a second common conduit communicating with the other end of the cylinder of each of said cylinder-and-piston means for feeding into respectively discharging pressure fluid from said cylinder.

17. A hydraulic wrench as defined in claim 3, including means cooperating with said at least one pawl mounted on said lever means and corresponding means cooperating with said at least one pawl mounted on said link means for disengaging the respective pawl from the respective ratchet gear.

* * * * *